US009319779B2

(12) United States Patent
Jenkner et al.

(10) Patent No.: US 9,319,779 B2
(45) Date of Patent: Apr. 19, 2016

(54) SYSTEM AND METHOD FOR TRANSDUCER BIASING AND SHOCK PROTECTION

(71) Applicant: Infineon Technologies AG, Neubiberg (DE)

(72) Inventors: Christian Jenkner, Klagenfurt (AT); Richard Gaggl, Poertschach am (AT); Benno Muehlbacher, St. Magdalen (AT)

(73) Assignee: Infineon Technologies AG, Neubiberg (DE)

( * ) Notice: Subject to any disclaimer, the term of this patent is extended or adjusted under 35 U.S.C. 154(b) by 247 days.

(21) Appl. No.: 14/060,417

(22) Filed: Oct. 22, 2013

(65) Prior Publication Data

US 2015/0110296 A1 Apr. 23, 2015

(51) Int. Cl.

| | |
|---|---|
| ***H04R 3/00*** | (2006.01) |
| ***H04R 1/08*** | (2006.01) |
| ***H04R 17/02*** | (2006.01) |

(52) U.S. Cl.

CPC .. *H04R 3/00* (2013.01); *H04R 1/08* (2013.01); *H04R 3/007* (2013.01); *H04R 17/02* (2013.01); *H04R 2201/003* (2013.01); *H04R 2410/00* (2013.01)

(58) Field of Classification Search

None

See application file for complete search history.

(56) References Cited

U.S. PATENT DOCUMENTS

2010/0246859 A1* 9/2010 David ..... G05F 1/467 381/120

* cited by examiner

*Primary Examiner* — Regina N Holder

(74) *Attorney, Agent, or Firm* — Slater & Matsil, L.L.P.

(57) ABSTRACT

In accordance with an embodiment, an interface circuit includes an amplifier configured to be coupled to a transducer, a first bypass circuit coupled to a first voltage reference and the amplifier, a second bypass circuit coupled to the first voltage reference and the amplifier, and a control circuit coupled to the second bypass circuit. The first bypass circuit conducts a current when an input signal amplitude greater than a first threshold is applied to the transducer and the control circuit causes the second bypass circuit to conduct a current for a first time period after the first bypass circuit conducts a current.

22 Claims, 7 Drawing Sheets

SYSTEM AND METHOD FOR TRANSDUCER BIASING AND SHOCK PROTECTION

TECHNICAL FIELD

The present invention relates generally to transducers, and, in particular embodiments, to a system and method for transducer biasing and shock protection.

BACKGROUND

Transducers convert signals from one domain to another and are often used in sensors. A common sensor with a transducer that is seen in everyday life is a microphone, a sensor for audio signals with a transducer that converts sound waves to electrical signals.

Microelectromechanical system (MEMS) based sensors include a family of transducers produced using micromachining techniques. MEMS, such as a MEMS microphone, gather information from the environment through measuring physical phenomena, and electronics attached to the MEMS then process the signal information derived from the sensors. MEMS devices may be manufactured using micromachining fabrication techniques similar to those used for integrated circuits.

Audio microphones are commonly used in a variety of consumer applications such as cellular telephones, digital audio recorders, personal computers and teleconferencing systems. In a MEMS microphone, a pressure sensitive diaphragm is disposed directly onto an integrated circuit. As such, the microphone is contained on a single integrated circuit rather than being fabricated from individual discrete parts.

MEMS devices may be formed as oscillators, resonators, accelerometers, gyroscopes, pressure sensors, microphones, micro-mirrors, and other devices, and often use capacitive sensing techniques for measuring the physical phenomenon being measured. In such applications, the capacitance change of the capacitive sensor is converted into a usable voltage using interface circuits. In many applications, large amplitude physical signals caused by shock or similar events can overload the MEMS device and permanently or temporarily affect performance. In a MEMS microphone, shock events may affect an amount of charge on the capacitive plates. The performance of the MEMS, and especially the sensitivity, is related to the amount of charge on the capacitive plates. Thus, interface circuits for MEMS microphones are generally designed with charge biasing in mind.

SUMMARY OF THE INVENTION

In accordance with an embodiment, an interface circuit includes an amplifier configured to be coupled to a transducer, a first bypass circuit coupled to a first voltage reference and the amplifier, a second bypass circuit coupled to the first voltage reference and the amplifier, and a control circuit coupled to the second bypass circuit. The first bypass circuit conducts a current when an input signal amplitude greater than a first threshold is applied to the transducer and the control circuit causes the second bypass circuit to conduct a current for a first time period after the first bypass circuit conducts a current.

BRIEF DESCRIPTION OF THE DRAWINGS

For a more complete understanding of the present invention, and the advantages thereof, reference is now made to the following descriptions taken in conjunction with the accompanying drawing, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of various embodiments are discussed in detail below. It should be appreciated, however, that the various embodiments described herein are applicable in a wide variety of specific contexts. The specific embodiments discussed are merely illustrative of specific ways to make and use various embodiments, and should not be construed in a limited scope.

Description is made with respect to various embodiments in a specific context, namely microphone transducers, and more particularly, MEMS microphones. Some of the various embodiments described herein include MEMS transducer systems, MEMS microphone systems, interface circuits for transducer and MEMS transducer systems, biasing circuits for MEMS transducer systems, and shock protection and recovery for MEMS transducer systems. In other embodiments, aspects may also be applied to other applications involving any type of sensor or transducer converting a physical signal to another domain and interfacing with electronics according to any fashion as known in the art.

An aspect of the embodiments described herein provides an interface circuit for a microphone that biases the microphone, protects the microphone during a shock event, and rapidly restores a voltage bias after a shock event. According to various embodiments, a current is induced in various parts of the interface circuit during a shock event, the current is detected by a current detection block, and a control circuit receives information related to the detected current and modifies an impedance of a portion of the interface circuit. In some embodiments, the impedance is modified for a time period during and/or after the shock event. With respect to specific embodiments, the impedance is lowered during and/or after the shock event, thereby allowing the voltage bias to be more quickly restored.

Figure 1:
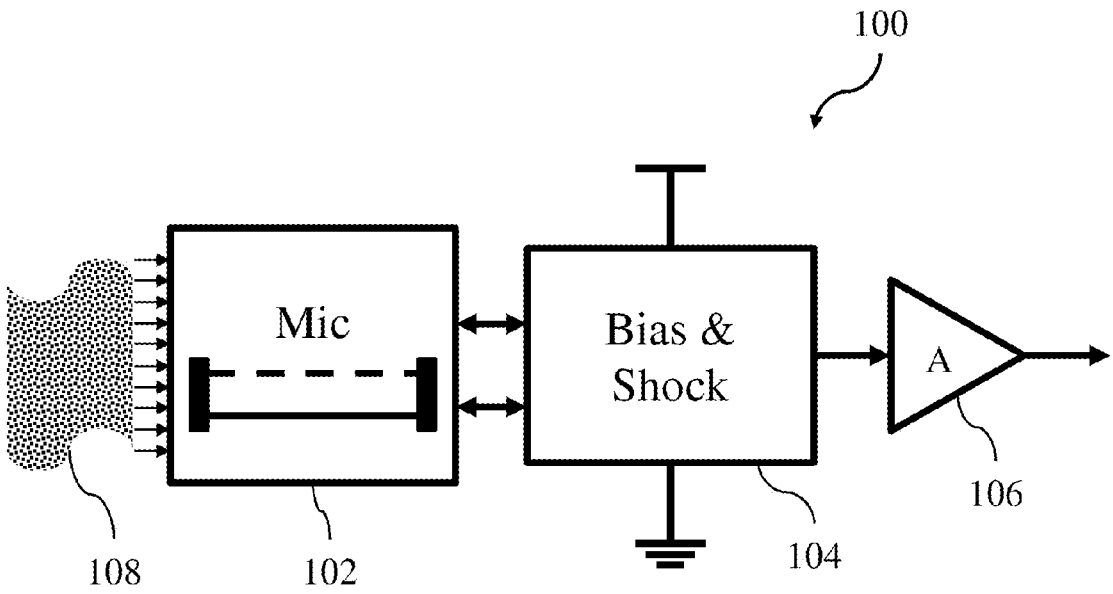
FIG. 1 illustrates a block diagram of an embodiment microphone system.

FIG. 1 illustrates a block diagram of an embodiment microphone system 100 including a bias and shock circuit 104 coupled to microphone 102 and amplifier 106. In the block diagram illustrated, microphone system 100 receives a sound wave 108 as an input into microphone 102. In various embodiments, microphone 102 may include a capacitive MEMS microphone with a backplate and diaphragm. The sound wave 108 may cause the diaphragm to be displaced, producing a voltage signal output from microphone 102 into bias and shock circuit 104, which then supplies the voltage signal to amplifier 106. According to various embodiments, bias and shock circuit 104 maintains a bias charge level on microphone 102 during normal operation. In specific embodiments, the bias charge level on microphone 102 is directly related to the sensitivity of microphone system 100.

Amplifier 106 may have a gain A. In other embodiments, amplifier 106 may be part of a multi-stage amplifier circuit resulting in an overall gain of A. During normal operation, sound wave 108 is converted from a pressure signal to an amplified voltage signal by microphone system 100.

According to various embodiments, bias and shock circuit 104 provides a current path for the charge on microphone 102 during a shock event and helps to restore a bias voltage on microphone 102 after the shock event. In various embodiments, a shock event may include dropping microphone system 100, physical impact on a sound port of microphone system 100, or extremely large sound signals in the environment, for example. In such a shock event, microphone 102 may be susceptible to damage if the bias charge on microphone 102 is not allowed to flow as current off microphone 102. Bias and shock circuit 104 may provide current paths from microphone 102 to a reference voltage, such as a voltage source or ground terminal for example.

Following a shock event, bias and shock circuit 104 may modify an impedance value of a coupling between microphone 102 and a reference voltage in order to more quickly restore the bias voltage value. In various embodiments, because the bias voltage (i.e. the amount of charge on the microphone) is affected during a shock event, the sensitivity following a shock event will be substantially affected. If the sensitivity is not restored quickly, altered microphone system performance may be detectable by a human observer. For example, the quality of a recorded signal will be audibly affected. In a specific embodiment, bias and shock circuit 104 may close a switch between a reference voltage and microphone 102 for a period of time. In some embodiments, the period of time may begin during the shock event. In other embodiments, the period of time may begin after the shock event. The period of time when the switch is closed may be set to a specific time period. In some embodiments, a current flowing through the closed switch may be monitored and the switch may be opened when the current approaches a threshold value.

Figure 2:
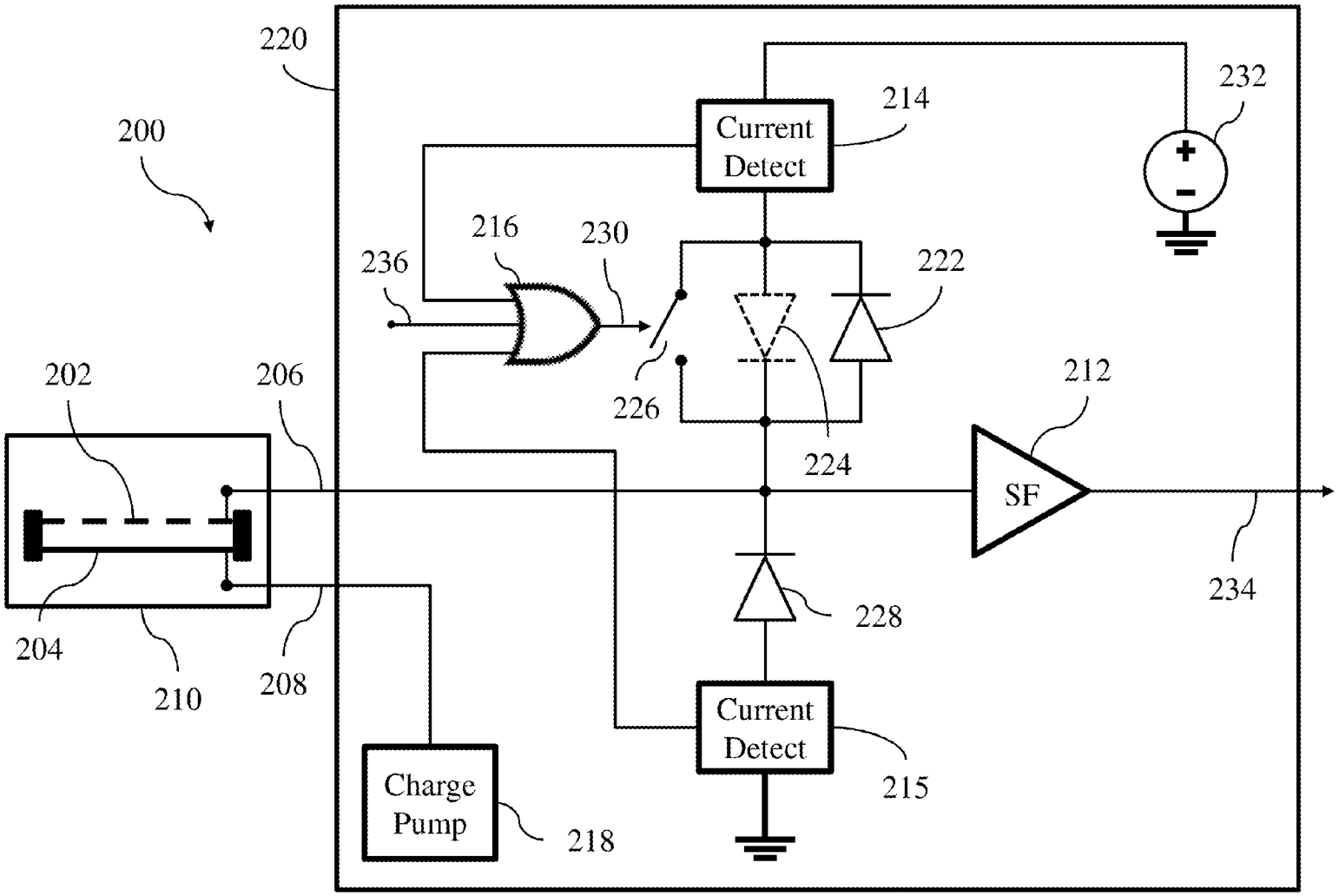
FIG. 2 illustrates a schematic of an embodiment MEMS microphone system.

FIG. 2 illustrates a schematic of an embodiment MEMS microphone system 200 including a capacitive MEMS microphone 210 attached to an interface circuit 220 via terminals 206 and 208. MEMS microphone 210 includes a deflectable membrane 204 coupled to terminal 208 and a perforated rigid backplate 202 coupled to terminal 206. According to various embodiments, a sound wave from a sound port (not shown) incident on membrane 204 causes membrane 204 to deflect. The deflection changes the distance between membrane 204 and backplate 202, thereby changing the capacitance because backplate 202 and membrane 204 form a parallel plate capacitor. The change in capacitance is detected as a voltage change between terminals 206 and 208. Interface circuit 220 measures the voltage change between terminals 206 and 208 and provides an output signal at output 234 that corresponds to the sound wave incident on membrane 204.

In the embodiment shown, amplifier 212 is coupled to terminal 206 and receives voltage signals from MEMS microphone 210. Amplifier 212 amplifies the voltage signals received from MEMS microphone 210 and provides the output signal to output 234. In other embodiments, amplifier 212 is the first stage in a multi-stage amplifier cascade. As specifically shown, amplifier 212 may be a source-follower amplifier.

According to various embodiments, MEMS microphone system 200 has a sensitivity that is directly related to a bias voltage applied via terminals 206 and 208 to backplate and diaphragm 202 and 204, respectively. Because the sensitivity is directly related to bias voltage, MEMS microphone system 200 may be operated with a constant amount of charge on backplate 202 and diaphragm 204. Charge pump 218 and voltage source 232 may together supply the bias voltage to MEMS microphone 210 and establish the constant amount of charge. In various embodiments, a small leakage current may be present between backplate 202 and diaphragm 204. Charge pump 218 and voltage source 232 may also compensate for the small leakage current.

In order to maintain a constant charge on backplate 202 and diaphragm 204, an impedance seen from terminal 206 may be very large. In some specific embodiments, the impedance may be on the order of 10 GΩ In other specific embodiments, the impedance may be on the order of 100 GΩ or higher.

If a shock event occurs, the charge on the MEMS microphone 210 may forward bias diode 222 (for a pressure increase shock) and/or diode 228 (for a pressure decrease shock) coupled to terminal 206 at an input to amplifier 212 and cause a current to flow through diode 222 and/or diode 228. Because terminal 206 is a high impedance input to interface circuit 220, a voltage change may be applied before either diode 222 or 228 is forward biased and conducts a current. In some embodiments, an anti-parallel diode 224 may be included next to diode 222 and coupled terminal 206 in order to bias the circuit node at terminal 206. Diode 224 operates only if the voltage difference between voltage source 232 and terminal 206 is above the diode drop of 224. In some embodiments, diode 224 improves biasing during startup. In additional embodiments, diode 224 provides biasing current in case of MEMS leakage while maintaining a high input impedance at terminal 206.

In the embodiment shown, current detect block 214 is coupled between diode 222 and voltage source 232 and current detect block 215 is coupled between diode 228 and a ground node. Current detect block 214 detects a current through diode 222 and current detect block 215 detects a current through diode 228. In alternative embodiments, a single current detect block 214 may be used. In further embodiments, current detect block 214 may be coupled to other circuit elements in other positions within interface circuit 220.

After a shock event, because charge has moved off the MEMS microphone 210, the sensitivity may be altered. In some embodiments, because diodes 222 and 228 only conduct a current during a shock event, a current detected in either current detect block 214 or 215 is indicative of a shock event. According to various embodiments, current detect block 214 or 215 is used to indicate a shock event via a detected current by providing a current detect signal to logical OR gate 216. In other embodiments, OR gate 216 may be implemented using other digital logic or control circuits and may include control logic other than a logical OR. OR gate 216 provides switch control signal 230 to switch 226. Switch 226 is coupled in parallel with diode 222 and, when closed, bypasses diode 222 and lowers the impedance seen at terminal 206. According to various embodiments, a detected current by current detect block 214 or 215 may cause OR gate 216 to close switch 226 using switch control signal 230. Closing switch 226 may more rapidly restore the constant charge amount on MEMS microphone 210 from voltage source 232 and restore the nominal sensitivity after a shock event.

According to various embodiments, restoring nominal sensitivity and function of a microphone after a shock event is completed in less than 50 ms. In some embodiments, due to the high impedance of the circuit attached to terminal 206, restoring a constant charge amount on MEMS microphone 210 may take between 50 ms and 1-10 seconds if switch 226 is open. However, if switch 226 is closed, restoring a constant charge amount on MEMS microphone 210 may take less than 50 ms. In some embodiments, restoring a constant charge amount on MEMS microphone 210 may take less than 10 ms if switch 226 is closed. In further embodiments, restoring a constant charge amount on MEMS microphone 210 may take less than 50 μs if switch 226 is closed. In accordance with such various embodiments, a time period after a shock event during which switch 226 remains closed may have variable length. The time period may be a fixed time, such as 20 ms for example. In some embodiments, the time period may depend on a current detected signal from current detect block 214 or 215.

According to another embodiment, when MEMS microphone system 200 is turned on, establishing an initial charge level on MEMS microphone 210 may be delayed because of the high impedance seen at terminal 206. In such an embodiment, input 236 may be used to indicate a start-up condition to OR gate 216, which will provide switch control signal 230 to close switch 226. Closing switch 226 during a start-up condition may enable MEMS microphone system 200 to reach an operating charge level and nominal sensitivity more quickly, as described above with reference to shock recovery.

Figure 3:
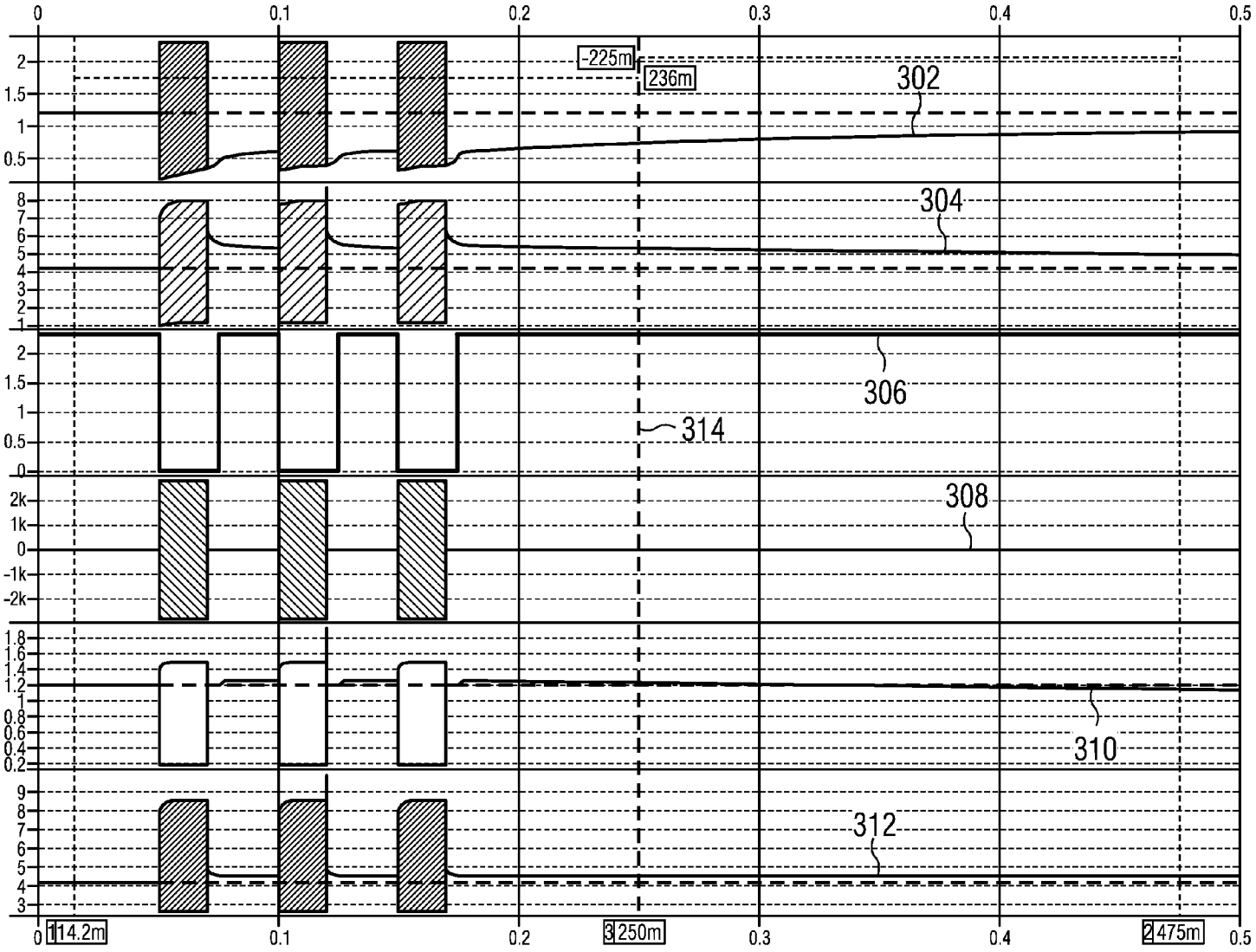
FIG. 3 illustrates a waveform diagram of an embodiment microphone system in operation.

FIG. 3 illustrates a waveform diagram of an embodiment microphone system 300 in operation and demonstrates improved shock recovery when various aspects of embodiments described herein are employed. Waveform 302 depicts an output voltage of a microphone system having no functionality of shock detection and recovery and waveform 304 depicts a bias voltage applied to a microphone within the microphone system. Waveform 306 depicts a shock detection signal and waveform 308 depicts a shock stimulus. Waveform 310 depicts the output voltage of a microphone system with shock detection and recovery and waveform 312 depicts the bias voltage applied to a microphone with shock detection and recovery. According to various embodiments, the output voltage may correspond to output 234 in FIG. 2, and the bias voltage may correspond to a voltage applied between terminals 206 and 208 in FIG. 2, for example.

According to the embodiment shown, shock recovery is faster with detection and recovery functionality according to embodiments described herein. At time 314, which is less than 100 ms after a third shock event, output voltage waveform 302 and bias voltage waveform 304 are substantially separated from the respective initial values. At time 314, output voltage waveform 310 and bias voltage waveform 312, having shock recovery, are much closer to the initial values compared to waveforms 302 and 304, having no shock recovery.

Figure 4:
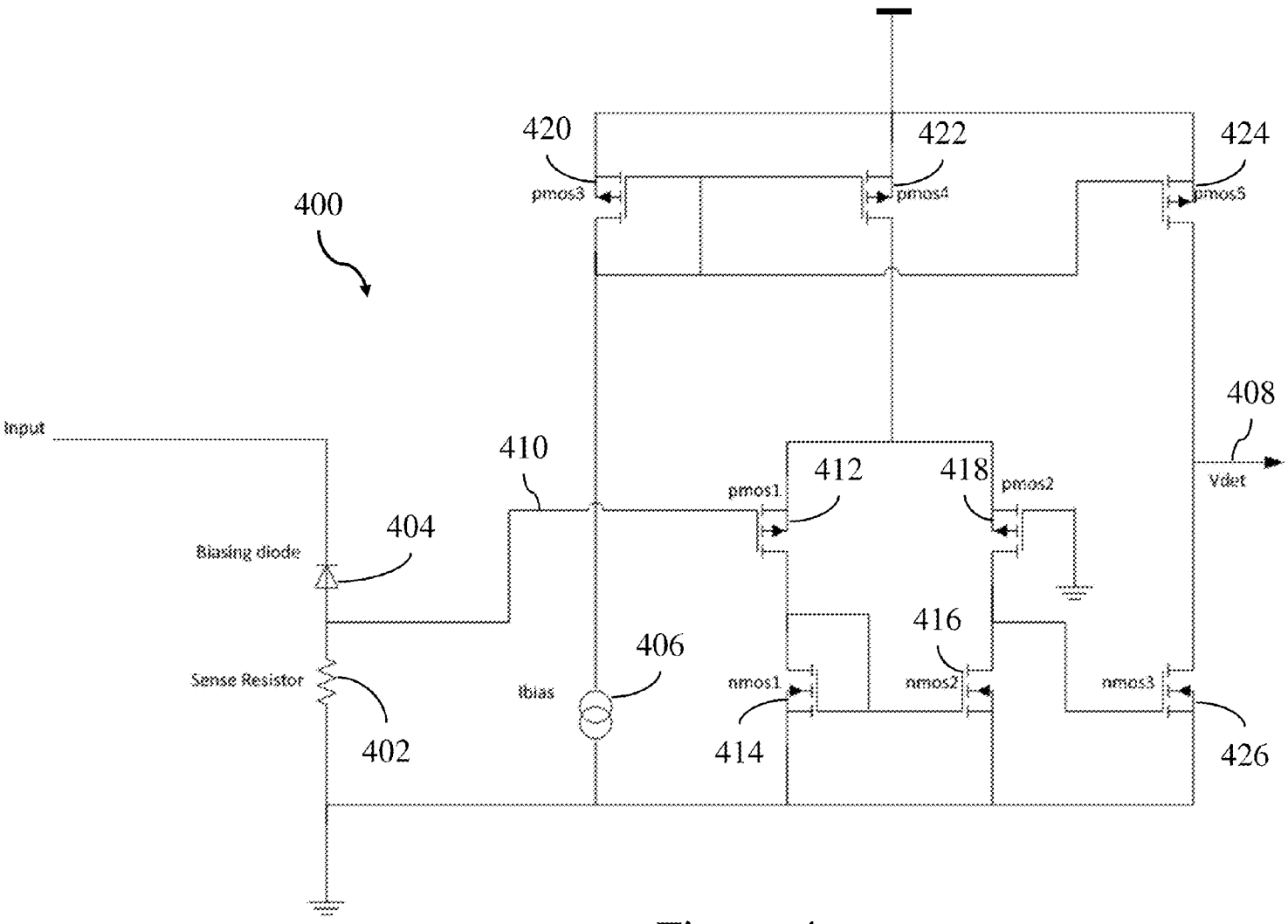
FIG. 4 illustrates a schematic of an embodiment current detection block.

FIG. 4 illustrates a schematic of an embodiment current detection block 400 that may be used to implement current detect block 215 in FIG. 2. In the embodiment shown, a current flows through resistor 402 and diode 404. In various embodiments, diode 404 corresponds to diode 228 in FIG. 2. Resistor 402 converts the current, which may be produced by a shock event, to a voltage. In some embodiments, a shock event may cause diode 404 to be forward biased if an input voltage is more than one diode drop below ground. If diode 404 is forward biased, comparator input signal 410 may be pulled below ground and cause output 408 to go high. Input signal 410 is compared to a second input (GND) of the comparator at MOSFET 418. The comparison result is then output on output 408, which may drive OR gate 216 in FIG. 2, for example. In another embodiment, the output 408 may include a hysteresis, which is not shown in the drawing. The same current detection block can be used to implement current detect block 214 for detecting the current through diode 222 in FIG. 2 by exchanging the NMOS/PMOS and VDD/GND connections, as is known by those skilled in the art.

Figure 5:
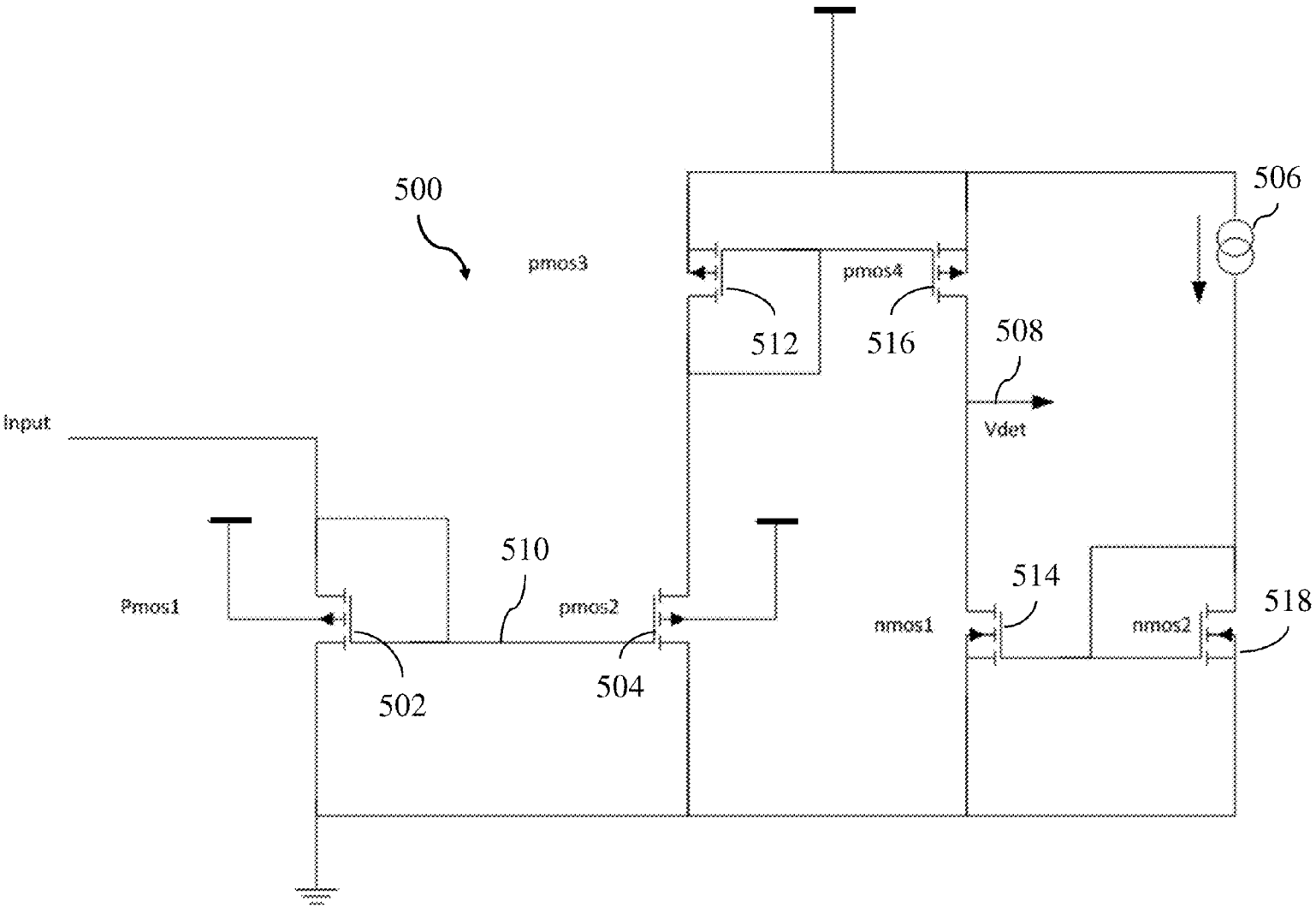
FIG. 5 illustrates a schematic of another embodiment current detection block.

FIG. 5 illustrates a schematic of another embodiment current detection block 500 that also may be used to implement current detect block 215 in FIG. 2. In the embodiment shown, a MOSFET 502 is coupled to an input and is configured as a MOS diode. In various embodiments, this MOS diode corresponds to the diode 228 in FIG. 2. MOSFET 502 is coupled to the remainder of current detection block 500 which compares the current flowing through MOSFET 502 with reference current source 506. If a voltage on the input drops below ground by the diode drop of the MOS diode with MOSFET 502, current flows through MOSFET 502 from ground to input. Such a current will cause MOSFET 504 to conduct a current because MOSFETs 502 and 504 are coupled as a current mirror. If the current flowing through MOSFET 504 is larger than reference current source 506, output 508 indicates a detected current by going high. In some embodiments, output 508 is coupled to OR gate 216. In some embodiments, current detection block 500 could be reoriented with respect to a voltage source (instead of ground) by exchanging NMOS/PMOS and VDD/GND in order to implement current detect block 214 in FIG. 2, for example.

Figure 6:
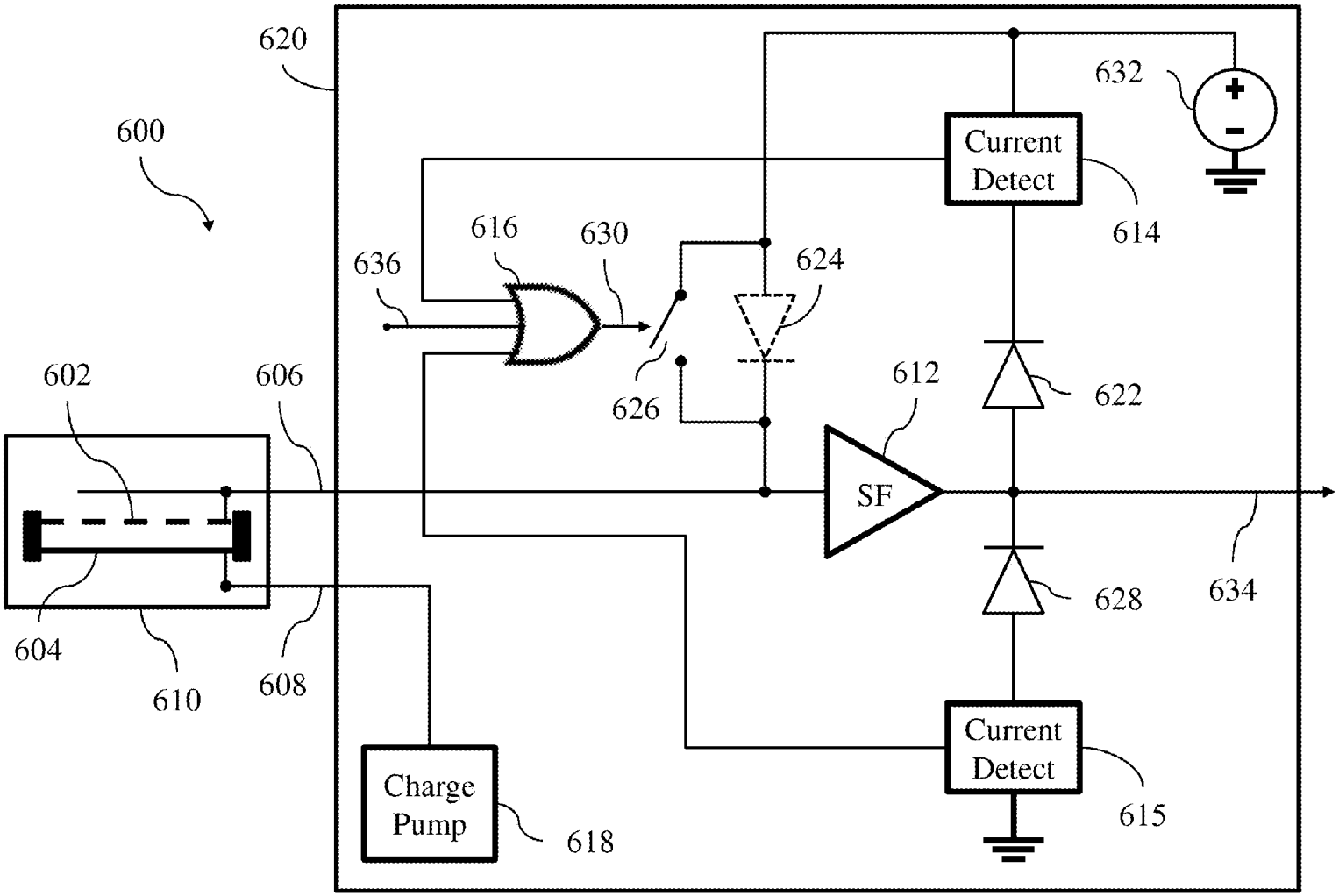
FIG. 6 illustrates a schematic of another embodiment MEMS microphone system.

FIG. 6 illustrates a schematic of another embodiment MEMS microphone system 600 having current detect blocks 614 and 615 and diodes 622 and 628 attached to an output of amplifier 612. Operation of MEMS microphone system 600 with MEMS microphone 610 and interface circuit 620 is similar to MEMS microphone system 200 with MEMS microphone 210 and interface circuit 220. Placement of current detect blocks 614 and 615 and diodes 622 and 628 on an output of amplifier 612 provides a different measurement point, but operation of MEMS microphone system 600 is generally the same as described with reference to MEMS microphone system 200 in FIG. 2 and will not be described again.

Figure 7:
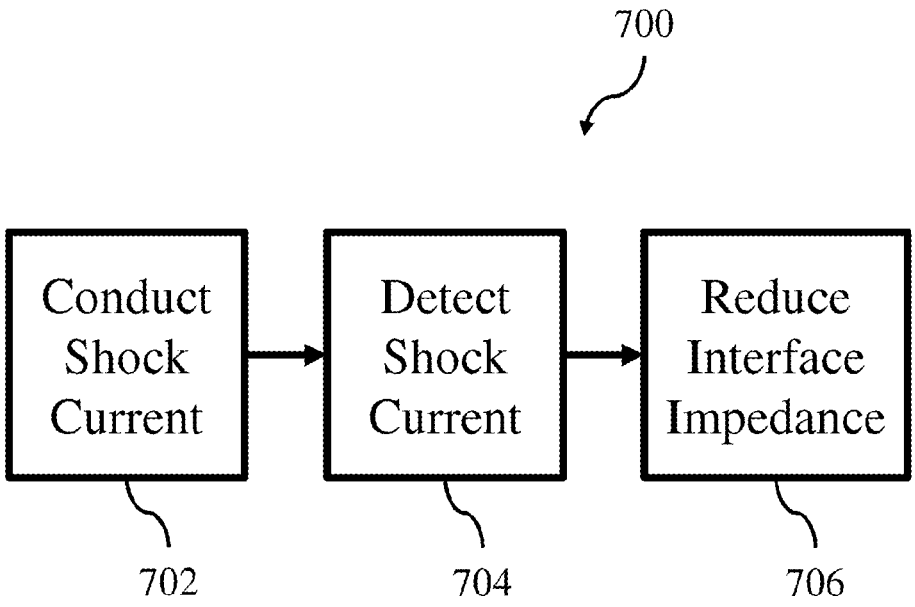
FIG. 7 illustrates a block diagram of an embodiment method of operation of a microphone system.

FIG. 7 illustrates a block diagram of an embodiment method of operation 700 of a microphone system including steps 702, 704, and 706 for protecting against and recovering from a shock event to a microphone. Step 702 includes conducting a current caused by a shock event away from plates of the microphone. Step 704 includes detecting the current flowing away from the plates of the microphone. Step 702 may correspond to forward biasing a diode. In other embodiments, step 702 may correspond to closing a switch. Following step 704, step 706 includes reducing the impedance of an interface circuit coupled to the plates of the MEMS microphone. In various embodiments, reducing the impedance of an interface circuit may include closing a switch. In further embodiments, the switch may be coupled between a plate of the MEMS microphone and a reference voltage source. In specific embodiments, step 706 may include reducing the impedance for a specific time period until the plates of the MEMS microphone have a nominal charge level with a corresponding sensitivity value.

In accordance with an embodiment, an interface circuit includes an amplifier configured to be coupled to a transducer, a first bypass circuit coupled to a first voltage reference and the amplifier, a second bypass circuit coupled to the first voltage reference and the amplifier, and a control circuit coupled to the second bypass circuit. The first bypass circuit conducts a current when an input signal amplitude greater than a first threshold is applied to the transducer and the control circuit causes the second bypass circuit to conduct a current for a first time period after the first bypass circuit conducts a current.

In various embodiments, the first bypass circuit includes a diode. The interface circuit may also include a first current detection block coupled to the first bypass circuit and the second bypass circuit. In some embodiments, the first current detection block provides a control signal indicative of a detected current to the control circuit. The second bypass circuit may include a semiconductor switch having a first conduction terminal coupled to the first voltage reference, a second conduction terminal coupled to the amplifier, and a control terminal for receiving a switching control signal. In accordance with an embodiment, the control circuit receives the control signal from the first current detection block and provides the switching control signal to the control terminal of the second bypass circuit.

According to some embodiments, the interface circuit includes a third bypass circuit coupled to a second voltage reference and the amplifier, and the third bypass circuit conducts a current when an input signal amplitude greater in magnitude than a second threshold is applied to the transducer. The interface circuit may also include a second current detection block coupled to the third bypass circuit, and the second current detection block provides an additional control signal indicative of a detected current to the control circuit.

In various embodiments, the first, second, and third bypass circuits are coupled to an input of the amplifier. The control circuit causes the second bypass circuit to conduct a current for the first time period dependent on the switching control signal. The control circuit includes digital control logic in some embodiments. The interface circuit may include a bias generator configured to be coupled to the transducer. In some embodiments, the interface circuit includes the transducer. The transducer may be a capacitive microelectromechanical system (MEMS) microphone having a backplate and a deflectable membrane.

In accordance with an embodiment, a method of operating a transducer includes conducting a current from the transducer when an input signal having an amplitude greater in magnitude than a threshold value is input to the transducer, detecting the current from the transducer, and reducing an impedance between the transducer and a voltage source after detecting the current. The method may also include maintaining a constant charge on the transducer during normal operation. In some embodiments, reducing the impedance between the transducer and a voltage source includes closing a switch coupled between the transducer and a voltage source. The method may further include reducing the impedance between the transducer and the voltage source during a startup phase.

In accordance with an embodiment, a microphone system includes a capacitive MEMS microphone, an amplifier coupled to a first capacitive plate of the MEMS microphone, and a charge control circuit coupled to the amplifier. The charge biasing circuit includes a first diode coupled to the amplifier, a bypass switch coupled to the amplifier and in parallel with the first diode, a current detection circuit coupled to the first diode and the bypass switch, and a switch control circuit coupled to the current detection circuit and controls the bypass switch.

In various embodiments, the microphone system includes a second diode coupled to the amplifier, an additional current detection circuit coupled to the second diode and to the switch control circuit, and/or a bias generator coupled to a second capacitive plate of the MEMS microphone. In some embodiments, the switch control circuit includes a logical OR gate. The first diode may be coupled to an input of the amplifier. The microphone system may include a third diode coupled in parallel with the first diode, and an anode of the first diode may be coupled to a cathode of the third diode.

Advantages of various aspects of the embodiments and modifications thereof as described herein include directly sensing a change of stored charge on a capacitive MEMS sensor through detecting a current after the high impedance node, start and end time detection for shock events without introducing disturbing observers to the system, shock detection with improved reliability, shock detection independent of biasing conditions, and shock detection without added parasitic components or noise sources. A further advantage includes quickly biasing a microphone to a nominal bias voltage following a shock event and during a start-up phase.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An interface circuit comprising:

an amplifier configured to be coupled to a transducer;

a first bypass circuit coupled to a first voltage reference and the amplifier, wherein the first bypass circuit is configured to conduct a first current when an input signal amplitude greater than a first threshold is applied to the transducer;

a second bypass circuit coupled to the first voltage reference and the amplifier; and a control circuit coupled to the second bypass circuit and configured to cause the second bypass circuit to conduct a second current for a first time period after the first bypass circuit conducts the first current.

2. The interface circuit of claim 1, wherein the first bypass circuit comprises a diode.

3. The interface circuit of claim 1, further comprising a first current detection block coupled to the first bypass circuit and the second bypass circuit, wherein the first current detection block is configured to detect the first current, and provide a control signal indicative of detecting the first current to the control circuit.

4. The interface circuit of claim 3, wherein the second bypass circuit comprises a semiconductor switch having a first conduction terminal coupled to the first voltage reference, a second conduction terminal coupled to the amplifier, and a control terminal configured to receive a switching control signal.

5. The interface circuit of claim 4, wherein the control circuit is further configured to receive the control signal from the first current detection block and provide the switching control signal to the control terminal of the second bypass circuit.

6. The interface circuit of claim 5, further comprising:

a third bypass circuit coupled to a second voltage reference and the amplifier, wherein the third bypass circuit is configured to conduct a current when an input signal amplitude greater in magnitude than a second threshold is applied to the transducer; and a second current detection block coupled to the third bypass circuit, wherein the second current detection block is configured to provide an additional control signal indicative of a detected current to the control circuit.

7. The interface circuit of claim 6, wherein the first, second, and third bypass circuits are coupled to an input of the amplifier.

8. The interface circuit of claim 5, wherein the control circuit is further configured to cause the second bypass circuit to conduct a current for the first time period dependent on the switching control signal.

9. The interface circuit of claim 5, wherein the control circuit comprises digital control logic.

10. The interface circuit of claim 1, further comprising a bias generator configured to be coupled to the transducer.

11. The interface circuit of claim 1, further comprising the transducer.

12. The interface circuit of claim 11, wherein the transducer is a capacitive microelectromechanical system (MEMS) microphone having a backplate and a deflectable membrane.

13. A method of operating a transducer comprising:

conducting a current from the transducer when an input signal having an amplitude greater in magnitude than a threshold value is input to the transducer;

detecting the current from the transducer; and reducing an impedance between the transducer and a voltage source after detecting the current.

14. The method of claim 13, further comprising maintaining a constant charge on the transducer during normal operation.

15. The method of claim 13, wherein conducting the current from the transducer comprises conducting the current through a bypass circuit, detecting the current from the transducer comprises detecting the current at a current detection circuit coupled to the bypass circuit, and reducing the impedance between the transducer and the voltage source comprises closing a switch coupled between the transducer and a voltage source based on detecting the current at the current detection circuit.

16. The method of claim 13, further comprising reducing the impedance between the transducer and the voltage source during a startup phase.

17. A microphone system comprising:

a capacitive microelectromechanical system (MEMS) microphone;

an amplifier coupled to a first capacitive plate of the MEMS microphone; and a charge control circuit coupled to the amplifier, wherein the charge control circuit comprises:

a first diode coupled to the amplifier;

a bypass switch coupled to the amplifier and in parallel with the first diode;

a current detection circuit coupled to the first diode and the bypass switch and configured to detect a current in the first diode; and a switch control circuit coupled to the current detection circuit and configured to control the bypass switch based on information received from the current detection circuit.

18. A microphone system comprising:

a capacitive microelectromechanical system (MEMS) microphone;

an amplifier coupled to a first capacitive plate of the MEMS microphone; and a charge control circuit coupled to the amplifier, wherein the charge control circuit comprises:

a first diode coupled to the amplifier;

a bypass switch coupled to the amplifier and in parallel with the first diode;

a current detection circuit coupled to the first diode and the bypass switch; and a switch control circuit coupled to the current detection circuit and configured to control the bypass switch;

a second diode coupled to the amplifier; and an additional current detection circuit coupled to the second diode and to the switch control circuit.

19. The microphone system of claim 17, further comprising a bias generator coupled to a second capacitive plate of the MEMS microphone.

20. The microphone system of claim 17, wherein the switch control circuit comprises a logical OR gate.

21. The microphone system of claim 17, wherein the first diode is coupled to an input of the amplifier.

22. A microphone system comprising:

a capacitive microelectromechanical system (MEMS) microphone; an amplifier coupled to a first capacitive plate of the MEMS microphone; and a charge control circuit coupled to the amplifier, wherein the charge control circuit comprises:

a first diode coupled to the amplifier;

a bypass switch coupled to the amplifier and in parallel with the first diode; a current detection circuit coupled to the first diode and the bypass switch; and a switch control circuit coupled to the current detection circuit and configured to control the bypass switch; and a second diode coupled in parallel with the first diode, wherein an anode of the first diode is coupled to a cathode of the second diode.

* * * * *